US007452644B2

(12) United States Patent
Tanaka et al.

(10) Patent No.: US 7,452,644 B2
(45) Date of Patent: Nov. 18, 2008

(54) ELECTROPHOTOGRAPHIC PHOTOSENSITIVE MEMBER, PROCESS CARTRIDGE, AND ELECTROPHOTOGRAPHIC APPARATUS

(75) Inventors: Masato Tanaka, Shizuoka-ken (JP); Masataka Kawahara, Mishimi (JP); Atsushi Fujii, Yokohama (JP); Yuka Ishizuka, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/358,204

(22) Filed: Feb. 22, 2006

(65) Prior Publication Data

US 2006/0172208 A1 Aug. 3, 2006

Related U.S. Application Data

(60) Division of application No. 11/151,309, filed on Jun. 14, 2005, now Pat. No. 7,097,950, which is a continuation of application No. PCT/JP2005/008515, filed on May 10, 2005.

(30) Foreign Application Priority Data

May 27, 2004 (JP) ..... 2004-157521

(51) Int. Cl.
*G03G 5/047* (2006.01)

(52) U.S. Cl. ..... 430/59.4; 430/60; 430/61; 430/64; 399/116; 399/159

(58) Field of Classification Search ..... 430/59.2, 430/59.4, 60, 61, 64, 72; 399/116, 159
See application file for complete search history.

(56) References Cited

U.S. PATENT DOCUMENTS

| | | | | |
|---|---|---|---|---|
| 4,734,348 | A | 3/1988 | Suzuki et al. | 430/96 |
| 4,830,942 | A | 5/1989 | Fukagai et al. | |
| 4,830,943 | A | 5/1989 | Sasaki et al. | |
| 4,963,450 | A | 10/1990 | Miyazaki et al. | |
| 5,080,991 | A | 1/1992 | Ono et al. | 430/73 |
| 5,192,632 | A | 3/1993 | Ohmura et al. | |
| 5,344,736 | A | 9/1994 | Komiyama et al. | 430/83 |
| 5,430,526 | A | 7/1995 | Ohkubo et al. | 399/159 |
| 5,658,702 | A | 8/1997 | Nukada | |
| 5,928,824 | A * | 7/1999 | Obinata et al. | 430/62 |
| 6,040,100 | A | 3/2000 | Tanaka et al. | 430/72 |
| 6,190,811 | B1 | 2/2001 | Tanaka et al. | 430/78 |
| 6,261,729 | B1 * | 7/2001 | Yuh et al. | 430/65 |
| 6,348,290 | B1 * | 2/2002 | Yokota | 430/57.3 |
| 6,593,046 | B2 * | 7/2003 | Sorriero et al. | 430/64 |
| 2005/0181292 | A1 * | 8/2005 | Fujii et al. | 430/72 |

FOREIGN PATENT DOCUMENTS

| | | | |
|---|---|---|---|
| EP | 0 715 217 | A2 | 6/1996 |
| EP | 1 264 919 | A2 | 12/2002 |
| JP | 58-095351 | A | 6/1983 |
| JP | 58-095744 | A | 6/1983 |
| JP | 59-031962 | A | 2/1984 |
| JP | 59-139051 | A | 8/1984 |
| JP | 61-184552 | A | 8/1986 |
| JP | 62-269966 | A | 11/1987 |
| JP | 62-276561 | A | 12/1987 |
| JP | 62-276563 | A | 12/1987 |
| JP | 01-183663 | A | 7/1989 |
| JP | 2-15040 | | 1/1990 |
| JP | 02-015040 | A | 1/1990 |
| JP | 02-082263 | A | 3/1990 |
| JP | 03-120236 | A | 5/1991 |
| JP | 4-88349 | A | 3/1992 |
| JP | 04-116563 | A | 4/1992 |
| JP | 4-147265 | A | 5/1992 |
| JP | 4-149448 | A | 5/1992 |
| JP | 04-310964 | A | 11/1992 |
| JP | 5-6012 | A | 1/1993 |
| JP | 5-134436 | A | 5/1993 |
| JP | 07-175249 | A | 7/1995 |
| JP | 08-087124 | * | 4/1996 |
| JP | 08-087124 | A | 4/1996 |
| JP | 08-202122 | | 8/1996 |
| JP | 08-328284 | A | 12/1996 |
| JP | 09-015889 | A | 1/1997 |
| JP | 09-22135 | A | 1/1997 |
| JP | 09-258468 | A | 10/1997 |
| JP | 10-153871 | A | 6/1998 |

(Continued)

OTHER PUBLICATIONS

USPTO English-language translation of JP 08-202122 (pub. Aug. 1996).*
USPTO English-language translation of JP 10-301317 (Nov. 1998).*
Japanese Patent Office machine-assisted translation of JP 2004-101699 (pub. Apr. 2004).*
Japanese Patent Office machine-assisted translation of JP 08-087124 (pub. Apr. 1996).*
USPTO English-language translation of JP 2004-101699 (pub. Apr. 2004).*
USPTO English-language translation of JP 08-087124 (pub. Apr. 1996).*
Yutake Morita, et al., Chemistry Letters, "Synthesis and Crystal Structure of Calix[4]quinone", pp. 1349-1352, (1989).

(Continued)

*Primary Examiner*—Janis L Dote
(74) *Attorney, Agent, or Firm*—Fitzpatrick, Cella, Harper & Scinto

(57) ABSTRACT

An electrophotographic photosensitive member capable of outputting an image in which a defect such as a ghost is suppressed even in a high-temperature-and-high-humidity environment, and in which a defect such as a change in density due to an abrupt change in light-area potential at an initial stage or a ghost due to long-term durable use is suppressed even in a low-humidity environment; and a process cartridge and an electrophotographic apparatus each having the electrophotographic photosensitive member; are provided. The electrophotographic photosensitive member has a layer which comprises a compound having a specific structure between a support and a charge-generating layer.

10 Claims, 1 Drawing Sheet

FOREIGN PATENT DOCUMENTS

| | | | | |
|---|---|---|---|---|
| JP | 10-301317 | | | 11/1998 |
| JP | 11-316469 | | | 11/1999 |
| JP | 2003-186225 | A | | 7/2003 |
| JP | 2003-295489 | A | | 10/2003 |
| JP | 2003-316049 | | | 11/2003 |
| JP | 2003-316049 | A | | 11/2003 |
| JP | 2004-101699 | | * | 4/2004 |
| JP | 2004-121699 | A | | 4/2004 |

OTHER PUBLICATIONS

Diamond, A.S., ed., *handbook of Imaging Materials*, Marcel Dekker, Inc., NY (1991), pp. 395-396.

Japanese Patent Office machine-assisted translation of JP 10-301317 (pub. Nov. 1998).

Japanese Patent Office machine-assisted translation of JP 08-202122 (pub. Aug. 1996).

International Preliminary Report on Patentability of Appln. No. PCT/JP2005/008515, issued Nov. 29, 2006 (English translation).

European Search Report dated May 26, 2008, in application No. 05739157.5-1217.

Notice of Reason for Rejection dated Jul. 1, 2008, in Japanese application No. 2008-123372, and English-language translation.

* cited by examiner

ELECTROPHOTOGRAPHIC PHOTOSENSITIVE MEMBER, PROCESS CARTRIDGE, AND ELECTROPHOTOGRAPHIC APPARATUS

CROSS REFERENCE TO RELATED APPLICATION

This application is a divisional of application Ser. No. 11/151,309, filed Jun. 14, 2005, now U.S. Pat. No.7,097,950, which is a continuation of Application PCT/JP2005/008515, filed May 10, 2005, pending.

TECHNICAL FIELD

The present invention relates to an electrophotographic photosensitive member, and a process cartridge and an electrophotographic apparatus each having the electrophotographic photosensitive member.

BACKGROUND ART

An electrophotographic photosensitive member having a photosensitive layer using an organic photoconductive substance (an organic electrophotographic photosensitive member) can be produced more easily than an electrophotographic photosensitive member having a photosensitive layer using an inorganic photoconductive substance (an inorganic electrophotographic photosensitive member). In addition, the organic electrophotographic photosensitive member has an advantage that it has a high degree of freedom of function design because of its diversity of material selection. Thus, the organic electrophotographic photosensitive member has been widely used in the market owing to recent rapid proliferation of laser beam printers.

An electrophotographic photosensitive member having a lamination type layer structure has gone mainstream as the photosensitive layer of the organic electrophotographic photosensitive member from the viewpoint of durability, the lamination type layer structure being obtained by laminating, from a support side, a charge-generating layer comprising a charge-generating substance and a charge-transporting layer comprising a charge-transporting substance in this order.

In many cases, a layer is arranged between the support and the charge-generating layer, which is intended for, for example, covering a defect on the surface of the support, improving adhesive property between the support and the photosensitive layer, preventing interference fringes, protecting the photosensitive layer from electrical breakdown, and preventing the injection of charge from the support into the photosensitive layer (see, for example, JP-A 58-095351 (Patent Document 1) and JP-A 02-082263 (Patent Document 2)). Hereinafter, a layer arranged between a support and a charge-generating layer is referred to as an "intermediate layer".

The intermediate layer has the merit described above and a demerit that charge is apt to accumulate. For this reason, when images are printed (output) continuously, a large change in potential occurs, so an output image may have a problem.

For example, when an electrophotographic photosensitive member having an intermediate layer is used for an electrophotographic apparatus currently adopted widely in printers which uses a dark-area potential portion as a non-development portion and a light-area potential portion as a development portion (a so-called reversal development type), the sensitivity of a site irradiated with light at the time of the preceding printing increases owing to a reduction in light-area potential or in residual potential. Therefore, when a totally white image is output at the time of the subsequent printing, a ghost phenomenon (positive ghost) may occur, in which the preceding print portion is embossed with a black color.

In contrast, when a totally black image is output at the time of the subsequent printing when the sensitivity of a site irradiated with light at the time of the preceding printing decreases owing to an increase in light-area potential, a ghost phenomenon (negative ghost) may occur, in which the preceding print portion is embossed with a white color.

Various methods of reducing a change in potential such as an increase in residual potential or a reduction in initial potential when continuous printing is performed by using an electrophotographic photosensitive member having the intermediate layer have heretofore been proposed (see, for example, JP-A 62-269966 (Patent Document 3), JP-A 58-095744 (Patent Document 4), JP-A 04-310964 (Patent Document 5), JP-A 07-175249 (Patent Document 6), JP-A 08-328284 (Patent Document 7), JP-A 09-015889 (Patent Document 8), and JP-A 09-258468 (Patent Document 9)).

However, there may be cases involving problems such as a reduction in initial sensitivity and a reduction in chargeability. Therefore, continuous printing using the electrophotographic photosensitive member having the intermediate is susceptible to additional improvement.

In addition, demands for an electrophotographic photosensitive member have become more and more severe owing to recent trends toward high image quality and colorization. That is, an electrophotographic photosensitive member has been demanded, which shows no changes in properties due to a change in environment where the electrophotographic photosensitive member is used, and which causes no deterioration of an output image such as a change in potential or a ghost even in durable use.

In particular, in a high-temperature-and-high-humidity environment, solutions to: a reduction in dark-area potential (charging potential) or in light-area potential resulting from a reduction in resistance; a change in light-area potential due to durable use; and the promotion of a positive ghost; have been demanded.

In addition, in a low-humidity environment, solutions to: an abrupt increase in light-area potential resulting from an increase in resistance at an initial stage (about a period from a first revolution to a 500th revolution); a change in density of an output image due to such abrupt increase; and the promotion of a ghost due to durable use have also been demanded.

A method of suppressing a ghost involving adding a ghost alleviating agent to the intermediate layer has been proposed as one method of solving the above problems (see, for example, JP-A 2003-295489 (Patent Document 10) and JP-A 2003-316049 (Patent Document 11)).

However, durable use in a high-temperature-and-high-humidity environment or a low-humidity environment is still susceptible to improvement.

Further, an electrophotographic photosensitive member which allows the use of laser whose oscillation wavelength is a short wavelength (380 to 450 nm), and is adapted to high resolution has also been demanded.

[Patent Document 1] JP-A 58-095351
[Patent Document 2] JP-A 02-082263
[Patent Document 3] JP-A 62-269966
[Patent Document 4] JP-A 58-095744
[Patent Document 5] JP-A 04-310964
[Patent Document 6] JP-A 07-175249
[Patent Document 7] JP-A 08-328284
[Patent Document 8] JP-A 09-015889
[Patent Document 9] JP-A 09-258468
[Patent Document 10] JP-A 2003-295489
[Patent Document 11] JP-A 2003-316049

DISCLOSURE OF THE INVENTION

Problems to be Solved by the Invention

An object of the present invention is to provide: an electrophotographic photosensitive member capable of outputting an image in which an image defect such as a ghost is suppressed even in a high-temperature-and-high-humidity environment, and in which a change in image density due to an abrupt change in light-area potential at an initial stage and an image defect such as a ghost due to long-term durable use are suppressed even in a low-humidity environment; and a process cartridge and an electrophotographic apparatus each having the electrophotographic photosensitive member.

MEANS FOR SOLVING THE PROBLEMS

The inventors of the present invention have made extensive studies and paid attention to an intermediate layer arranged between a support and a charge-generating layer of an electrophotographic photosensitive member. As a result, the inventors have found that the above object can be achieved by incorporating a specific compound into the intermediate layer, thereby completing the present invention.

That is, the present invention is an electrophotographic photosensitive member, which comprises: a support; a charge-generating layer which is placed on the support, comprising a charge-generating substance; and a charge-transporting layer which is placed on the charge-generating layer, comprising a charge-transporting substance; wherein the electrophotographic photosensitive member comprises a layer, comprising at least one of a compound having a structure represented by the following formula (1) and a compound having a structure represented by the following formula (2), between the support and the charge-generating layer.

(1)

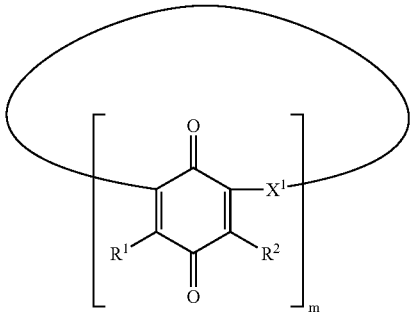

In the above formula (1), $R^1$ and $R^2$ each independently represent a hydrogen atom or a halogen atom, $X^1$ represents a methylene group or a carbonyl group (ketone group), and m represents an integer of 4 to 8.

In the above formula (2), $Ar^1$ and $Ar^2$ each independently represent a substituted or unsubstituted aryl group, $X^2$ represents a vinylene group or a p-phenylene group, and n represents 0 or 1.

In addition, the present invention is a process cartridge detachably attached to a main body of an electrophotographic apparatus, wherein the electrophotographic photosensitive member supports as one: the above electrophotographic photosensitive member; and at least one device selected from the group consisting of a charging device, a developing device, a transferring device, and a cleaning device.

In addition, the present invention is an electrophotographic apparatus, comprising: the above electrophotographic photosensitive member; a charging device; an exposing device; a developing device; and a transferring device.

EFFECT OF THE INVENTION

According to the present invention, there can be provided: an electrophotographic photosensitive member capable of outputting an image in which a defect such as a ghost is suppressed even in a high-temperature-and-high-humidity environment, and in which a change in density due to an abrupt change in light-area potential at an initial stage and a defect such as a ghost due to long-term durable use are suppressed even in a low-humidity environment; and a process cartridge and an electrophotographic apparatus each having the electrophotographic photosensitive member.

DESCRIPTION OF REFERENCE SYMBOLS

Figure 1:
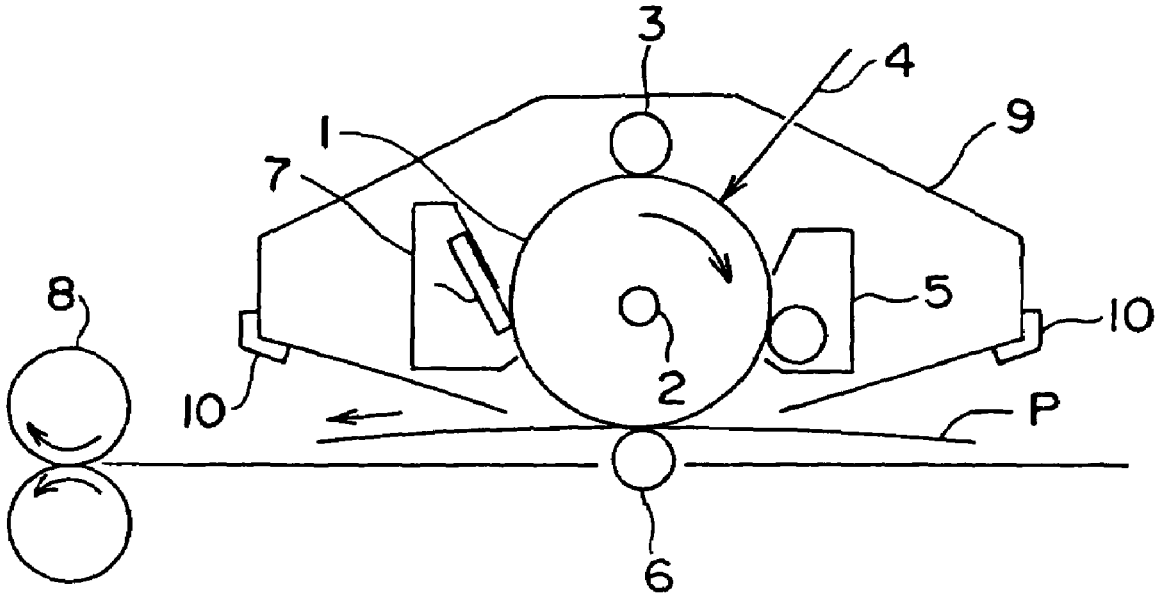
FIG. 1 is a view showing an example of a schematic composition of an electrophotographic apparatus equipped with a process cartridge having an electrophotographic photosensitive member of the present invention.

1 electrophotographic photosensitive member
2 shaft
3 charging device
4 exposure light (image exposure light)
5 developing device
6 transferring device
7 cleaning device
8 fixing device
9 process cartridge
10 guiding device
P transfer material (2)

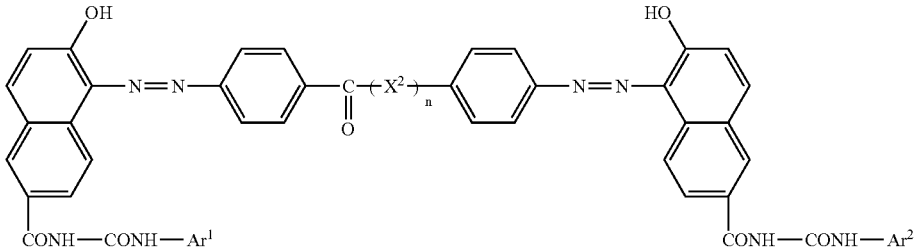

BEST MODE FOR CARRYING OUT THE INVENTION

Hereinafter, the present invention will be described in more detail.

The electrophotographic photosensitive member of the present invention is an electrophotographic photosensitive member, which comprises: a support; a charge-generating layer which is placed on the support, comprising a charge-generating substance; and a charge-transporting layer which is placed on the charge-generating layer, comprising a charge-transporting substance; wherein the electrophotographic photosensitive member comprises a layer, comprising at least one of a compound having a structure represented by the formula (1) and a compound having a structure represented by the formula (2), between the support and the charge-generating layer.

First, the compound having the structure represented by the formula (1) will be described.

The compound having the structure represented by the formula (1) to be used in the present invention is a cyclic oligomer (calixarene derivative) formed by coupling m structures derived from an aromatic compound shown in the brackets of the formula (1) in a cyclic manner.

Examples of halogen atoms represented by $R^1$ and $R^2$ in the formula (1) include a fluorine atom, a chlorine atom, and a bromine atom.

Examples of compounds that are suitably used in the present invention out of the compounds having structures each represented by the formula (1) are shown below. However, the present invention is not limited to those compounds.

Exemplified Compound (1-1)

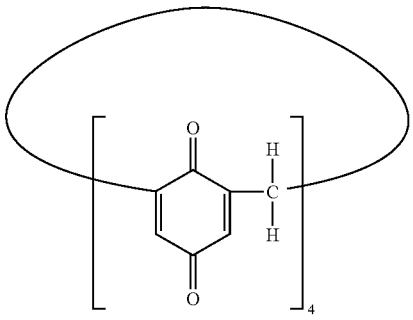

Exemplified Compound (1-2)

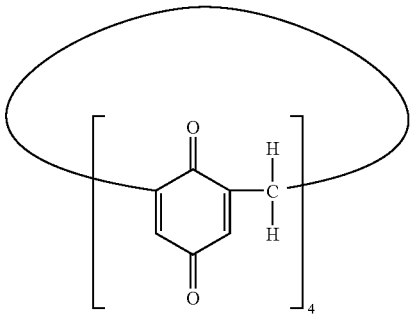

-continued

Exemplified Compound (1-3)

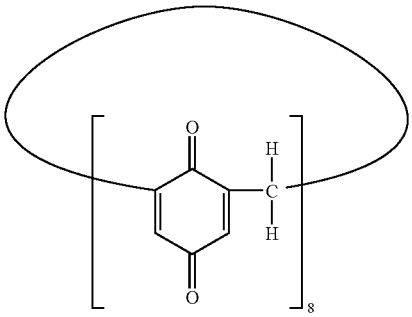

Exemplified Compound (1-4)

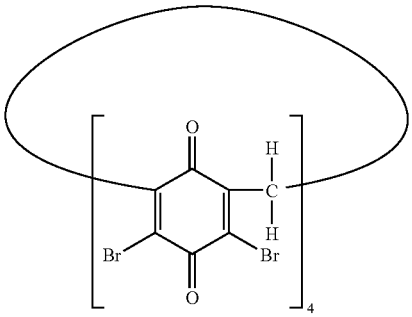

Exemplified Compound (1-5)

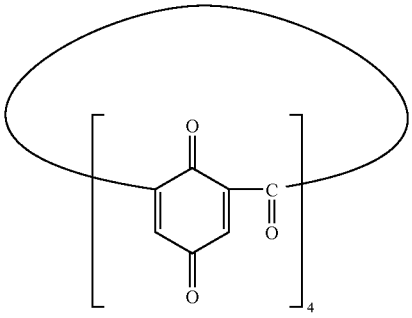

As described in, for example, JP-A 02-015040 or CHEMISTRY LETTERS, 1989, p 1349-1352, the compound having the structure represented by the formula (1) can be synthesized through phenylazocalixarene.

Next, the compound having the structure represented by the formula (2) will be described.

Examples of aryl groups represented by $Ar^1$ and $Ar^2$ in the formula (2) include a phenyl group and a naphthyl group. Examples of substituents which aryl groups represented by $Ar^1$ and $Ar^2$ may have include: alkyl groups such as a methyl group, an ethyl group, a propyl group, and a butyl group; halogen atom-substituted alkyl groups such as halomethyl groups (including a trifluoromethyl group and a tribromomethyl group); aryl groups such as a phenyl group, a biphenyl group, and a naphthyl group; alkoxy groups such as a methoxy group and an ethoxy group; halogen atom-substituted alkoxy groups such as a trifluoromethoxy group; dialkylamino groups such as a dimethylamino group and a diethylamino group; arylamino groups such as a phenylamino group and a diphenylamino group; halogen atoms such as a fluorine atom, a chlorine atom, and a bromine atom; a hydroxy group; a nitro group; a cyano group; an acetyl group;

and a benzoyl group. Of those, a fluorine atom, a chlorine atom, a bromine atom, a trifluoromethyl group, a trifluoromethoxy group, a nitro group, and the like are particularly preferable.

Examples of compounds that are suitably used in the present invention out of the compounds having structures each represented by the formula (2) are shown below. However, the present invention is not limited to those compounds.

Exemplified Compound (2-1)

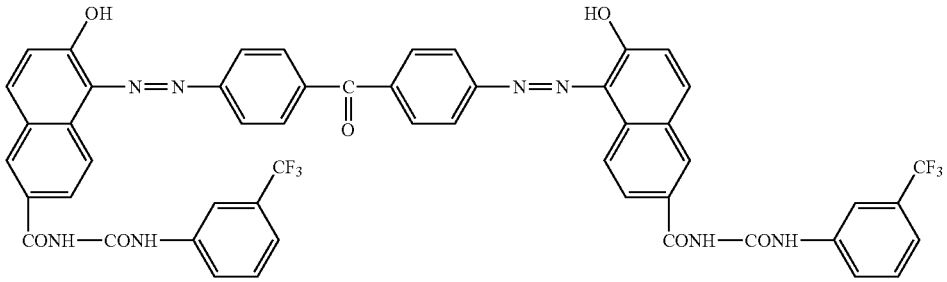

Exemplified Compound (2-2)

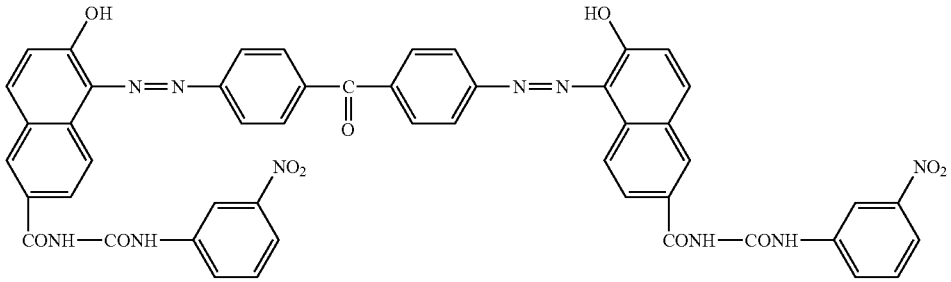

Exemplified Compound (2-3)

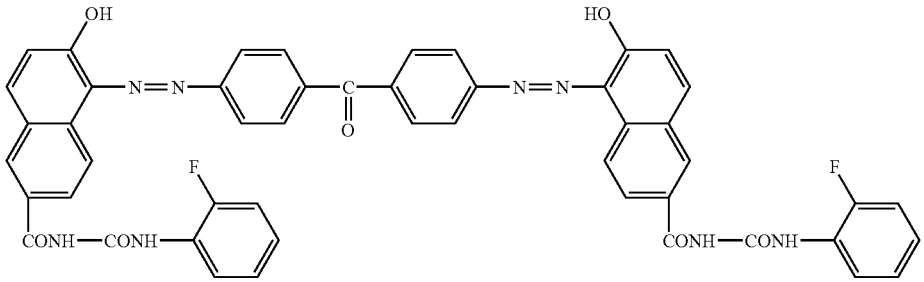

Exemplified Compound (2-4)

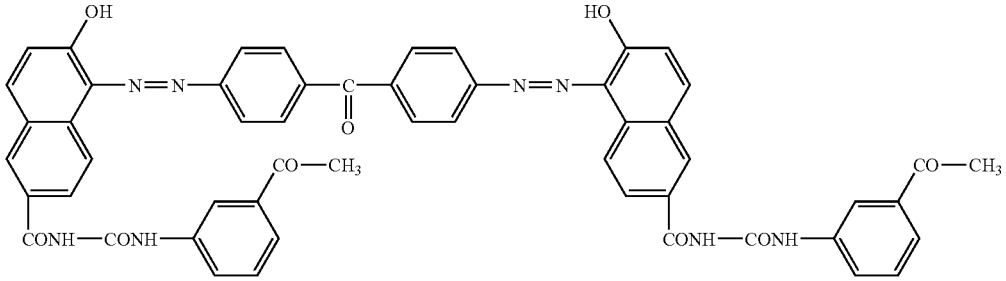

Exemplified Compound (2-5)

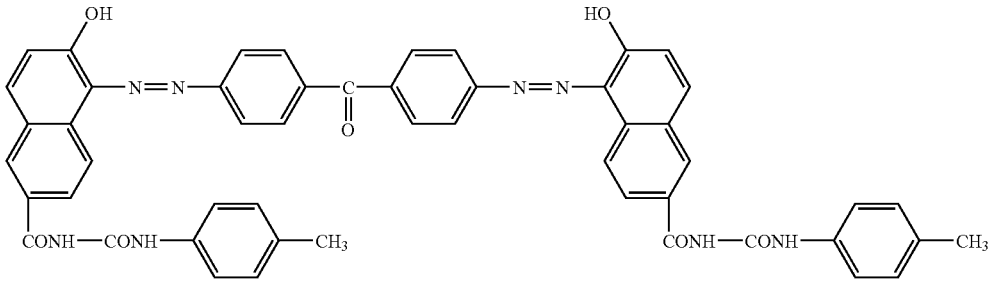

-continued
Exemplified Compound (2-6)
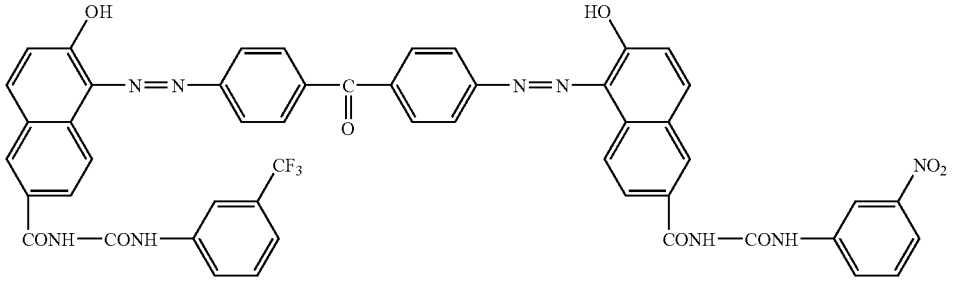
Exemplified Compound (2-7)
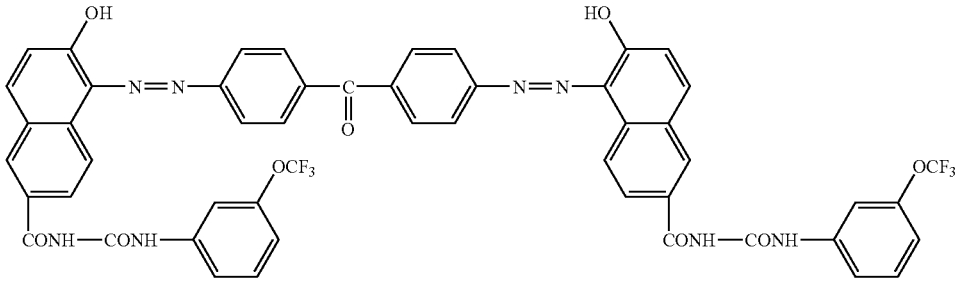
Exemplified Compound (2-8)
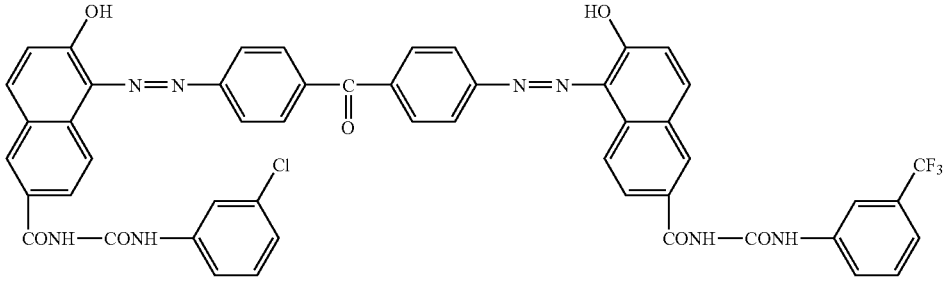
Exemplified Compound (2-9)
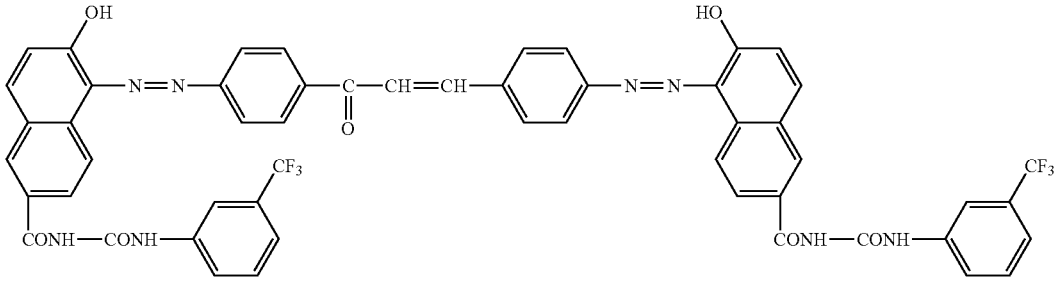
Exemplified Compound (2-10)
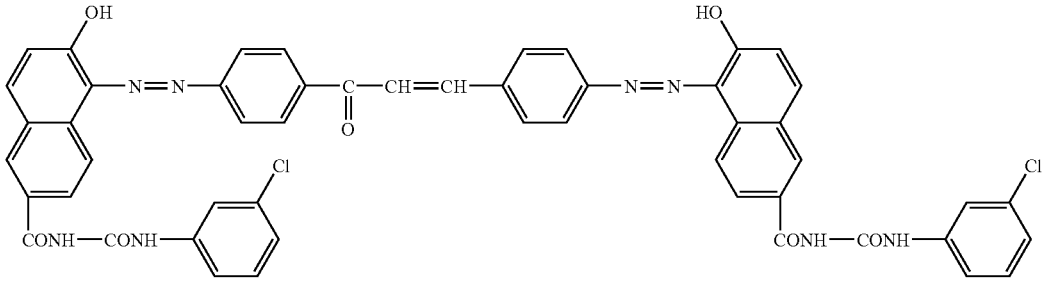

-continued

Exemplified Compound (2-11)

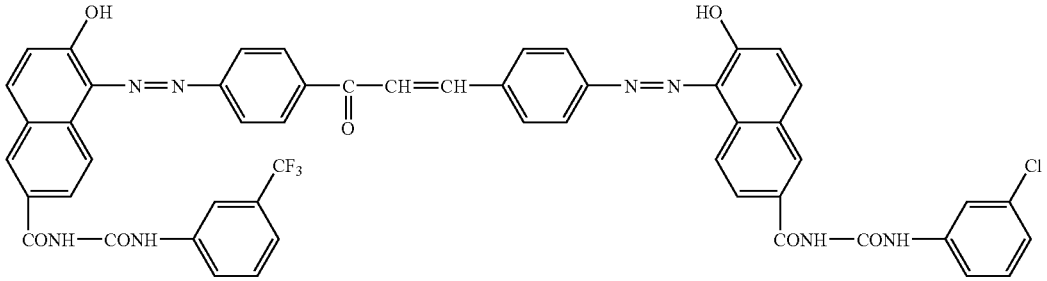

Exemplified Compound (2-12)

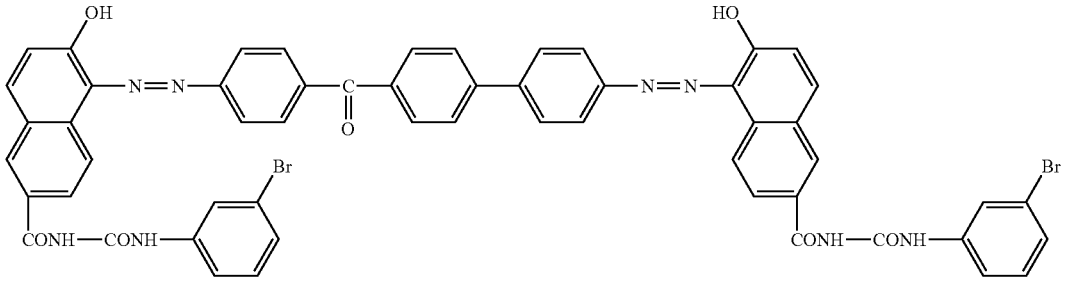

Exemplified Compound (2-13)

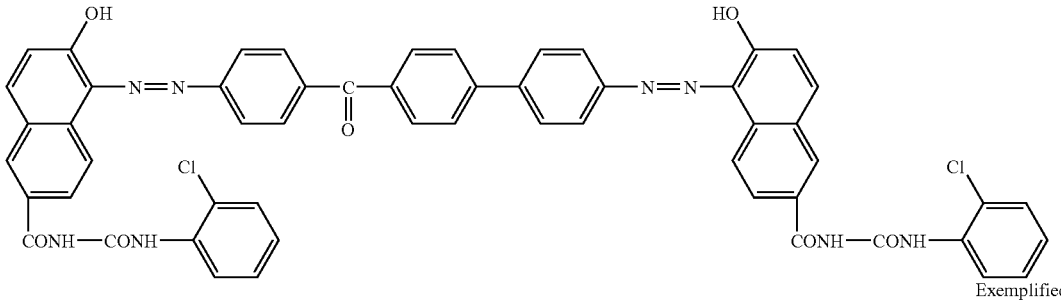

Exemplified Compound (2-14)

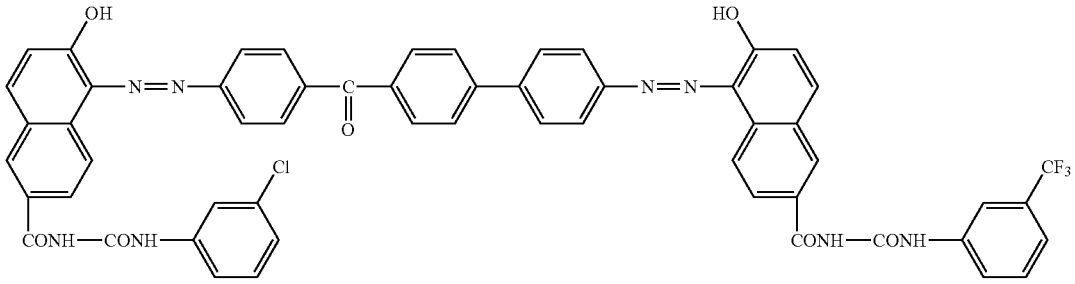

As described in, for example, JP-A 08-087124, the compound having the structure represented by the formula (2) can be synthesized according to a general method of producing an azo pigment.

The electrophotographic photosensitive member of the present invention is an electrophotographic photosensitive member which comprises: a support; a layer which is placed on the support, comprising at least one of a compound having a structure represented by the formula (1) and a compound having a structure represented by the formula (2) (hereinafter, referred to as an "intermediate layer I"); a charge-generating layer which is placed on the intermediate layer I, comprising a charge-generating substance; and a charge-transporting layer which is placed on the charge-generating layer, comprising a charge-transporting substance.

The support has only to be conductive (conductive support), and a support made of a metal (alloy) such as aluminum, stainless steel, or nickel may be used. A support obtained by forming a conductive film on metal, plastic, paper, or the like may also be used. Examples of the shape of the support include a cylindrical shape, a belt shape, and a film shape. In particular, a cylindrical support made of aluminum or aluminum alloy is preferable because it is excellent in mechanical strength, electrophotographic properties, and cost.

Although a plain tube may be used for the support, a tube subjected to: a physical treatment such as cutting or honing; anodizing; or a chemical treatment involving the use of an acid or the like may also be used. A tube having a ten point height of roughness profile (Rzjis 94) on its surface of 0.2 to 1.5 μm as a result of a physical treatment such as cutting or honing is preferable, and a tube having a ten point height of roughness profile on its surface of 0.4 to 1.2 μm is more preferable. The value of Rzjis 94 is obtained on the basis of JIS-B-0601:1994 with a measuring length of 8 mm and a cutoff wavelength of 0.8 mm.

The intermediate layer I can be formed by: applying, to the support (or another intermediate layer to be described later), an application liquid for the intermediate layer I prepared by dissolving or dispersing at least one of the compound having the structure represented by the formula (1) and the compound having the structure represented by the formula (2), and a binder resin into a solvent; and drying the applied liquid.

Examples of the binder resin used for the intermediate layer I include a phenol resin, an epoxy resin, a polyurethane resin, a polycarbonate resin, a polyallylate resin, a polyester resin, a polyamide resin, a polyimide resin, a polyamide-imide resin, a polyamide acid, a polyethylene resin, polystyrene, a styrene-acrylate copolymer resin, an acrylic resin, a polymethacrylate resin, a polyvinylalcohol resin, a polyvinyl acetal resin, a polyvinyl butyral resin, a polyvinyl benzal resin, a polyvinyl formal resin, a polyacrylonitrile resin, a polyacrylamide resin, an acrylonitrile-butadiene copolymer resin, a polyvinyl chloride resin, a vinyl chloride-vinyl acetate copolymer resin, a cellulose resin, a melamine resin, an amylose resin, an amylopectin resin, a polysulfone resin, a polyether sulfone resin, and a silicone resin. Each of those resins may be used alone, or 2 or more of them may be used as a mixture or a copolymer.

Of those resins, polyvinyl acetal resins such as a polyvinyl butyral resin and a polyvinyl benzal resin, and polyamide resins such as nylon 6, nylon 6,6, nylon 610, copolymerized nylon, and N-methoxymethylated nylon of N-alkoxymethylated nylon are preferable from the viewpoint of dispersibility of the compound having the structure represented by the formula (1) or the compound having the structure represented by the formula (2).

The intermediate layer I may contain a conductive substance for adjusting a volume resistivity, a dielectric constant, and the like. Examples of the conductive substance include: particles of metals such as aluminum and copper; particles of metal oxides such as aluminum oxide, tin oxide, indium oxide, titanium oxide, zirconium oxide, zinc oxide, silicon oxide, tantalum oxide, molybdenum oxide, and tungsten oxide; organometallic compounds such as zirconium tetra-n-butoxide, titanium tetra-n-butoxide, aluminum isopropoxide, and methylmethoxysilane; and carbon black. Each of those conductive substances may be used alone, or 2 or more of them may be used.

A ratio (A/B) of the total mass (A) of the compound having the structure represented by the formula (1) and the compound having the structure represented by the formula (2) in the intermediate layer I to the total mass (B) of the intermediate layer I is preferably 0.05 to 0.70. In particular, when the binder resin of the intermediate layer I is a polyamide resin, the ratio A/B is preferably 0.08 to 0.40. When the binder resin of the intermediate layer I is a polyvinyl acetal resin, the ratio A/B is preferably 0.50 to 0.70.

An excessively large value of the ratio (A/B) is not preferable because the applicability upon formation of the intermediate layer I and the stability of the application liquid may deteriorate. When the ratio is lower than 0.05, the content of the compound having a structure represented by the formula (1) or (2) is so low that an effect of the compound cannot be expected. The compound having a structure represented by the formula (1) or (2) can be used as one kind of compound or a mixture of 2 or more kinds of compounds.

Examples of the solvent used for the application liquid for the intermediate layer I include benzene, toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, dioxane, methylal, tetrahydrofuran, methanol, ethanol, isopropyl alcohol, butyl alcohol, methyl cellosolve, methoxy propanol, dimethylformamide, dimethylacetamide, and dimethylsulfoxide.

The intermediate layer I has a thickness of preferably 0.01 to 5 μm, more preferably 0.03 to 1.0 μm, or still more preferably 0.08 to 0.6 μm. In particular, when the binder resin of the intermediate layer I is a polyamide resin, the intermediate layer I preferably has a thickness of 0.3 to 0.6 μm. When the binder resin of the intermediate layer I is a polyvinyl acetal resin, the intermediate layer I preferably has a thickness of 0.08 to 0.3 μm.

A charge-generating layer comprising a charge-generating substance is placed on the intermediate layer I.

As the charge-generating substance used for the electrophotographic photosensitive member of the present invention, an azo pigment and a phthalocyanine pigment can be used.

Any one of various azo pigments such as monoazo, bisazo, trisazo, and tetrakisazo pigments can be used as the azo pigment. Of those, a benzanthrone-based azo pigment disclosed in each of JP-A 59-031962 and JP-A 01-183663 is preferable because it is a charge-generating substance which has excellent sensitivity but is apt to cause a ghost, so the present invention acts effectively.

Any one of various phthalocyanine pigments such as non-metal phthalocyanine, metal phthalocyanine having no axial ligand, and metal phthalocyanine having an axial ligand can be used as the phthalocyanine pigment. Of those, oxytitanium phthalocyanine or gallium phthalocyanine is preferable because it is a charge-generating substance which has excellent sensitivity but is apt to cause a ghost, so the present invention acts effectively.

In addition, gallium phthalocyanine to be used may have any one of various crystalline forms. Of those, a hydroxygallium phthalocyanine crystal of a crystalline form having strong peaks at 7.4°±0.3° and 28.2°±0.3° of 2θ±0.2° (θ represents a Bragg angle in CuKα X-ray diffraction) is more preferable. The hydroxygallium phthalocyanine crystal is preferable because it is a charge-generating substance which has more excellent sensitivity but is apt to cause a ghost and a change in density due to an abrupt change in light-area potential at an initial stage in a low-humidity environment, so the present invention acts effectively.

A charge-generating layer can be formed by: applying an application liquid for a charge-generating layer prepared by dispersing a charge-generating substance together with a solvent (and, as required, a binder resin); and drying the applied liquid. Examples of a dispersion method include methods involving the use of a homogenizer, an ultrasonic dispersing unit, a ball mill, a sand mill, a roll mill, a vibration mill, an atliter, a liquid collision-type high-speed dispersing unit, and the like. A ratio between the charge-generating substance and the binder resin is preferably in the range of 1:0.3 to 1:4 (mass ratio).

Examples of the binder resin used for the charge-generating layer include an acrylic resin, an allyl resin, an alkyd resin, an epoxy resin, a diallylphthalate resin, a silicone resin, a styrene-butadiene copolymer, nylon, a phenol resin, a butyral resin, a benzal resin, a polyacrylate resin, a polyacetal resin, a polyamide-imide resin, a polyamide resin, a polyallylether resin, a polyallylate resin, a polyimide resin, a polyurethane resin, a polyester resin, a polyethylene resin, a polycarbonate resin, a polystyrene resin, a polysulfone resin, a polyvinyl acetal resin, a polybutadiene resin, a polypropylene resin, a methacrylic resin, a urea resin, a vinyl chloride-vinyl acetate copolymer, a vinyl acetate resin, and a vinyl chloride resin. Of those, a butyral resin or the like is preferable. Each of those resins may be used alone, or 2 or more of them may be used as a mixture or a copolymer.

The solvent to be used for the application liquid for a charge-generating layer is selected on the basis of the solubility and dispersion stability of the binder resin or the charge-generating substance to be used. Examples of the solvent include organic solvents such as alcohol, sulfoxide, ketone, ether, ester, aliphatic halogenated hydrocarbons, and aromatic compounds.

The charge-generating layer has a thickness of preferably 0.01 to 10 μm, or more preferably 0.05 to 5 μm.

A charge-transporting layer containing a charge-transporting substance is placed on the charge-generating layer.

Examples of the charge-transporting substance used for the electrophotographic photoreceptor of the present invention include a triarylamine compound, a hydrazone compound, a styryl compound, a stilbene compound, a pyrazoline compound, an oxazole compound, a thiazole compound, and a triarylmethane compound. Each of those charge-transporting substances may be used alone, or 2 or more of them may be used.

A charge-transporting layer can be formed by: applying an application liquid for a charge-transporting layer prepared by dissolving a charge-transporting substance and a binder resin into a solvent; and drying the applied liquid. A ratio between the charge-transporting substance and the binder resin is in the range of preferably 5:1 to 1:5 (mass ratio), or more preferably 3:1 to 1:3 (mass ratio).

Examples of the binder resin used for the charge-transporting layer include an acrylic resin, an acrylonitrile resin, an allyl resin, an alkyd resin, an epoxy resin, a silicone resin, nylon, a phenol resin, a phenoxy resin, a butyral resin, a polyacrylamide resin, a polyacetal resin, a polyamide-imide resin, a polyamide resin, a polyallylether resin, a polyallylate resin, a polyimide resin, a polyurethane resin, a polyester resin, a polyethylene resin, a polycarbonate resin, a polystyrene resin, a polystyrene resin, a polysulfone resin, a polyvinyl butyral resin, a polyphenyleneoxide resin, a polybutadiene resin, a polypropylene resin, a methacrylic resin, a urea resin, a vinyl chloride resin, and a vinyl acetate resin. Each of those resins may be used alone, or 2 or more of them may be used as a mixture or a copolymer.

Examples of the solvent used for the application liquid for a charge-transporting layer include: ketones such as acetone and methyl ethyl ketone; esters such as methyl acetate and ethyl acetate; aromatic hydrocarbons such as toluene and xylene; ethers such as 1,4-dioxane and tetrahydrofuran; and hydrocarbons substituted by halogen atoms such as chlorobenzene, chloroform, and carbon tetrachloride.

The charge-transporting layer has a thickness of preferably 5 to 40 μm, or more preferably 10 to 30 μm.

In the present invention, between the support and the intermediate layer I, another intermediate layer: which has conductivity; which is different from the intermediate layer I; and which is intended for, for example, preventing interference fringes due to scattering of laser light or the like (hereinafter, the layer may be referred to as a "conductive layer"); may be arranged. The presence of the conductive layer eliminates the need for imparting an interference fringe preventing ability to the support itself, and allows a plain tube to be used as the support as it is. Therefore, the presence of the conductive layer is useful in terms of productivity and cost.

The conductive layer can be formed by: applying, to the support, an application liquid for a conductive layer prepared by dispersing inorganic particles made of tin oxide, indium oxide, titanium oxide, barium sulfate, or the like as well as a curable resin such as a phenol resin into an appropriate solvent; and drying (curing) the applied liquid.

The conductive layer preferably has a thickness of 3 to 20 μm.

In the present invention, between the support and the intermediate layer I, another intermediate layer: which has a barrier function or an adhesion function; and which is different from the intermediate layer I (hereinafter, the intermediate layer may be referred to as an "intermediate layer II"); may be arranged. The intermediate layer II is formed for, for example, improving adhesiveness of a photosensitive layer, improving applicability, improving property of injecting charge from the support, and protecting the photosensitive layer from electrical breakdown.

The intermediate layer II can be formed by using: a resin such as an acrylic resin, an allyl resin, an alkyd resin, an ethylcellulose resin, an ethylene-acrylic acid copolymer, an epoxy resin, a casein resin, a silicone resin, a gelatin resin, a phenol resin, a butyral resin, a polyacrylate resin, a polyacetal resin, a polyamide-imide resin, a polyamide resin (nylon, nylon 6,6, nylon 610, copolymerized nylon, or alkoxymethylated nylon and so on), a polyallylether resin, a polyimide resin, a polyurethane resin, a polyester resin, a polyethylene resin, a polycarbonate resin, a polystyrene resin, a polysulfone resin, a polyvinylalcohol resin, a polybutadiene resin, a polypropylene resin, or a urea resin; or a material such as aluminum oxide. Of those, a polyamide resin is preferable from the viewpoints of barrier and adhesion functions.

The intermediate layer II has a thickness of preferably 5 μm or less, or more preferably 0.3 to 2 μm.

In the present invention, a protective layer intended for protecting the charge-transporting layer may be placed on the charge-transporting layer.

The protective layer can be formed by: applying, to a photosensitive layer, an application liquid for a protective layer prepared by dissolving a resin for a protective layer into a solvent; and drying and/or curing, through heating, irradiation with ultraviolet light, irradiation with an electron beam, or the like, the applied liquid. Examples of the resin for a protective layer include a polyvinyl butyral resin, a polyester resin, a polycarbonate resin (polycarbonate Z or denatured polycarbonate, and the like), a polyamide resin, a polyimide resin, a polyallylate resin, a polyurethane resin, a styrene-butadiene copolymer, a styrene-acrylic acid copolymer, and a styrene-acrylonitrile copolymer.

The protective layer preferably has a thickness of 0.05 to 20 μm.

The protective layer may contain conductive particles such as metal oxide particles (for example, tin oxide particles); a UV absorbent; or lubricant particles such as fluorine atom-containing resin particles.

Any one of application methods such as dip-applying method (dip coating), spray coating, spinner coating, bead coating, blade coating, and beam coating may be used in applying the application liquid for each layer.

FIG. 1 shows an example of a schematic composition of an electrophotographic apparatus equipped with a process cartridge having the electrophotographic photosensitive member of the present invention.

In FIG. 1, reference numeral 1 denotes a cylindrical electrophotographic photosensitive member which is driven to rotate at a predetermined peripheral speed in the direction indicated by an arrow around a shaft 2.

The surface of the electrophotographic photosensitive member 1 to be driven to rotate is uniformly charged to a predetermined positive or negative potential by a charging device (primary charging device: charging roller or the like) 3. Next, the surface receives exposure light (image exposure light) 4 output from an exposing device (not shown) such as a slit exposure or a laser beam scanning exposure. Thus, electrostatic latent images corresponding to a target image are sequentially formed on the surface of the electrophotographic photosensitive member 1.

The electrostatic latent images formed on the surface of the electrophotographic photosensitive member 1 are developed with toner in the developer of a developing device 5 to be toner images. Next, the toner images formed and carried on the surface of the electrophotographic photosensitive member 1 are sequentially transferred by a transferring bias from a transferring device (such as a transfer roller) 6 onto a transfer material (such as paper) P taken and fed from a transfer material supply device (not shown) to a space between the electrophotographic photosensitive member 1 and the transferring device 6 (abutment portion) in synchronization with the rotation of the electrophotographic photosensitive member 1

The transfer material P onto which the toner images have been transferred is separated from the surface of the electrophotographic photosensitive member 1, and is then introduced into a fixing device 8 for fixing the toner images transferred onto the transfer material P to the transfer material P to receive image fixation. Thus, the transfer material P is printed out as an image formed product (print, copy) to the outside of the apparatus.

A transfer residual developer (toner) on the surface of the electrophotographic photosensitive member 1 after the transfer of the toner images is removed by a cleaning device (such as a cleaning blade) 7 to clean the surface. Furthermore, the cleaned surface is subjected to an antistatic treatment by pre-exposure light (not shown) from a pre-exposing device (not shown). After that, the surface of the electrophotographic photosensitive member 1 is repeatedly used for image formation. As shown in FIG. 1, when the charging device 3 is a contact charging device using a charging roller or the like, pre-exposure is not always needed. In addition, a cleaner-less system has been researched in recent years, so a transfer residual developer may be collected by a developing device or the like.

Out of the constituting elements including: the electrophotographic photosensitive member 1; the charging device 3 for charging the surface of the electrophotographic photosensitive member; the developing device 5 for developing an electrostatic latent image formed on the surface of the electrophotographic photosensitive member with toner to form a toner image on the surface of the electrophotographic photosensitive member; the transferring device 6 for transferring the toner image formed on the surface of the electrophotographic photosensitive member onto a transfer material; and the cleaning device 7 for cleaning the surface of the electrophotographic photosensitive member by removing an adduct such as toner remaining on the surface of the electrophotographic photosensitive member after the transfer, multiple constituting elements may be stored in a container and integrally connected to constitute a process cartridge. The process cartridge may be constituted so as to be detachably attached to the main body of an electrophotographic apparatus such as a copying machine or a laser beam printer.

In FIG. 1, the electrophotographic photosensitive member 1, the charging device 3, the developing device 5, and the cleaning device 7 are supported as one to constitute a process cartridge 9 that can be detachably attached to the main body of an electrophotographic apparatus by means of a guiding device 10 such as a rail of the main body of the electrophotographic apparatus.

In addition, laser having a short oscillation wavelength (380 to 450 nm) can be used as an exposing device for forming an electrostatic latent image on the charged surface of an electrophotographic photosensitive member by irradiating the surface of the electrophotographic photosensitive member with exposure light. With the exposing device, an increase in resolution can be achieved.

EXAMPLES

Hereinafter, the present invention will be described in more detail by way of specific examples. The terms "%" and "part" in examples mean "mass %" and "part by mass", respectively.

Example 1

Preparation of an Electrophotographic Photosensitive Member 1

An aluminum cylinder having a diameter of 30 mm was prepared as a support.

Next, 50 parts of titanium oxide particles coated with tin oxide containing 10% antimony oxide, 25 parts of a resole-type phenol resin, 20 parts of methyl cellosolve, 5 parts of methanol, and 0.002 part of silicone oil (polydimethylsiloxane-polyoxyalkylene copolymer, average molecular weight: 3,000) were dispersed for 2 hours by means of a sand mill device using glass beads each having a diameter of 0.8 mm to prepare an application liquid for a conductive layer.

The application liquid for a conductive layer was applied to the support by means of dip coating, and the resultant coating film was dried at 140° C. for 30 minutes to form a conductive layer having a thickness of 15 μm.

Next, 5 parts of a 6-66-610-12 quaternary polyamide copolymer resin were dissolved into a mixed solvent of 70 parts of methanol and 25 parts of butanol to prepare an application liquid for an intermediate layer II.

The application liquid for an intermediate layer II was applied to the conductive layer by means of dip coating, and the resultant coating film was dried to form an intermediate layer II having a thickness of 0.5 μm.

Next, 10 parts of Exemplified Compound (1-1) and 5 parts of a polyvinyl butyral resin (trade name: S-LEC® BX-1, manufactured by Sekisui Chemical Co., Ltd.) were added to 250 parts of cyclohexanone, and the whole was dispersed for 3 hours by means of a sand mill device using glass beads each having a diameter of 1 mm. 100 parts of cyclohexanone and 400 parts of ethyl acetate were added to the resultant dispersion to prepare an application liquid for an intermediate layer I.

The application liquid for an intermediate layer I was applied to the intermediate layer II by means of dip coating, and the resultant coating film was dried at 120° C. for 10 minutes to form an intermediate layer I having a thickness of 0.13 μm.

Next, 10 parts of a hydroxygallium phthalocyanine crystal of a crystal form having strong peaks at 7.5°, 9.9°, 16.3°, 18.6°, 25.1°, and 28.3° of 2θ±0.2° (θ represents a Bragg angle in CuKα X-ray diffraction) (charge-generating substance) and 5 parts of a polyvinyl butyral resin (trade name: S-LEC® BX-1, manufactured by Sekisui Chemical Co., Ltd.) were added to 250 parts of cyclohexanone, and the whole was dispersed for 3 hours by means of a sand mill device using glass beads each having a diameter of 0.8 mm. 100 parts of cyclohexanone and 450 parts of ethyl acetate were added to the resultant dispersion to prepare an application liquid for a charge-generating layer.

The application liquid for a charge-generating layer was applied to the intermediate layer I by means of dip coating, and the resultant coating film was dried at 100° C. for 10 minutes to form a charge-generating layer having a thickness of 0.16 μm.

Next, 10 parts of a compound having a structure represented by the following formula (3)

(3)

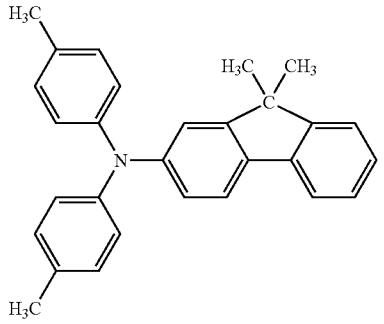

(charge-transporting substance) and 10 parts of a polycarbonate resin (trade name: IUPILON® Z-200, manufactured by Mitsubishi Gas Chemical Company, Inc.) were dissolved into 70 parts of monochlorobenzene to prepare an application liquid for a charge-transporting layer.

The application liquid for a charge-transporting layer was applied to the charge-generating layer by means of dip coating, and the resultant coating film was dried at 110° C. for 1 hour to form a charge-transporting layer having a thickness of 25 μm.

Thus, an electrophotographic photosensitive member 1 was produced, which was obtained by placing, on the support, the conductive layer, the intermediate layer II, the intermediate layer I, the charge-generating layer, and the charge-transporting layer in this order.

Evaluation of the Electrophotographic Photosensitive Member 1

The light-area potential of the electrophotographic photosensitive member 1 was measured as follows, and the electrophotographic photosensitive member 1 was evaluated for ghost as follows.

A reconstructed apparatus of a laser beam printer manufactured by Hewlett-Packard Development Company, L.P., a LASERJET® 4000 (trade name), (an apparatus reconstructed so as to be capable of changing a developing bias) was used as an evaluation apparatus, and the electrophotographic photosensitive member was mounted on the apparatus to perform evaluation.

A light-area potential (V1) was measured by: taking a cartridge for development out of the evaluation apparatus; and inserting a potential measuring device thereinto. The potential measuring device was constructed in such a manner that a potential measuring probe was arranged at a development position of the cartridge for development. The position of the potential measuring probe relative to the electrophotographic photosensitive member was substantially the central position in the axial direction of the electrophotographic photosensitive member with a gap from the surface of the electrophotographic photosensitive member of 3 mm. Output image data was a totally black image.

Evaluation for ghost was performed as follows.

An arbitrary number of 5-mm square black patterns were printed as images to be evaluated for ghost for one lap of the electrophotographic photosensitive member. After that, a totally halftone image (an image having a density of one dot one space) was output. The images to be evaluated for ghost were sampled in respective modes of 3 developing bias volumes: F1 (high density), F5 (central value), and F9 (low density). The evaluation was performed with the eyes, and the images were ranked according to the following evaluation criteria depending on the degree of ghost.

Rank 1: Level at which no ghost is observed in each mode.

Rank 2: Level at which a slight ghost is observed in one or more of the modes.

Rank 3: Level at which a ghost is observed in one or more of the modes.

Rank 4: Level at which a ghost is observed in each mode.

Rank 5: Level at which a ghost is clearly observed in one or more of the modes.

2 electrophotographic photosensitive members 1 were prepared. The initial light-area potential of each electrophotographic photosensitive member in a 23° C./50% RH environment (normal-temperature-and-normal-humidity environment: N/N) was measured, and each electrophotographic photosensitive member was evaluated for ghost in the same environment.

One of the electrophotographic photosensitive members 1 and the evaluation apparatus were left standing for 3 days in a 23° C./5% RH environment (normal-temperature-and-low-humidity environment: N/L). After that, the light-area potential of the electrophotographic photosensitive member in the same environment (N/L) was measured, and the electrophotographic photosensitive member was evaluated for ghost in the same environment (N/L). Furthermore, 500-sheet continuous durable printing (totally black image mode) was performed in the same environment (N/L). The light-area potential of the electrophotographic photosensitive member after the durable printing was measured, and the electrophotographic photosensitive member was evaluated for ghost after the durable printing. Furthermore, the electrophotographic photosensitive member was evaluated for change in light-area potential before and after the durable printing (ΔV1: light-area potential after durable printing—light-area potential before durable printing). Table 1 shows the results.

Next, the remaining one of the electrophotographic photosensitive members 1 and the evaluation apparatus were left standing for 3 days in a 30° C./80% RH environment (high-temperature-and-high-humidity environment: H/H). After that, the light-area potential of the electrophotographic photosensitive member in the same environment (H/H) was measured, and the electrophotographic photosensitive member was evaluated for ghost in the same environment (H/H). Furthermore, 3,000-sheet continuous durable printing (totally black image mode) was performed in the same environment (H/H). The light-area potential of the electrophotographic photosensitive member after the durable printing was measured, and the electrophotographic photosensitive member was evaluated for ghost after the durable printing. Furthermore, the electrophotographic photosensitive member was evaluated for change in light-area potential before and after the durable printing (ΔV1: light-area potential after durable printing—light-area potential before durable printing).

A difference between the maximum value of the light-area potential before durable printing and the minimum value thereof before durable printing in 3 environments was defined as an environmental change in potential. Table 1 shows the results.

Example 2

An electrophotographic photosensitive member 2 was produced in the same manner as in the electrophotographic photosensitive member 1 except that the thickness of the intermediate layer I was changed from 0.13 μm to 0.06 μm.

The electrophotographic photosensitive member 2 was evaluated in the same manner as in the electrophotographic photosensitive member 1 of Example 1. Table 1 shows the results.

Example 3

An electrophotographic photosensitive member 3 was produced in the same manner as in the electrophotographic photosensitive member 1 except that the thickness of the intermediate layer I was changed from 0.13 μm to 0.25 μm.

The electrophotographic photosensitive member 3 was evaluated in the same manner as in the electrophotographic photosensitive member 1 of Example 1. Table 1 shows the results.

Example 4

An electrophotographic photosensitive member 4 was produced in the same manner as in the electrophotographic photosensitive member 1 except that the thickness of the intermediate layer I was changed from 0.13 μm to 0.40 μm.

The electrophotographic photosensitive member 4 was evaluated in the same manner as in the electrophotographic photosensitive member 1 of Example 1. Table 1 shows the results.

Example 5

An electrophotographic photosensitive member 5 was produced in the same manner as in the electrophotographic photosensitive member 1 except that Exemplified Compound (1-1) used for the intermediate layer I was changed to Exemplified Compound (1-5).

The electrophotographic photosensitive member 5 was evaluated in the same manner as in the electrophotographic photosensitive member 1 of Example 1. Table 1 shows the results.

Example 6

A conductive layer was formed on a support in the same manner as in the electrophotographic photosensitive member 1.

Next, 10 parts of Exemplified Compound (1-1) were added to 500 parts of n-butanol, and the whole was dispersed for 20 hours by means of a sand mill device using glass beads each having a diameter of 1 mm. 20 parts of a 6-66-610-12 quaternary polyamide copolymer resin and 500 parts of methanol were added to the resultant dispersion, and the whole was dispersed for an additional 2 hours by means of the same sand mill device to prepare an application liquid for an intermediate layer I.

The application liquid for an intermediate layer I was applied on the conductive layer by means of dip coating, and the resultant coating film was dried at 80° C. for 10 minutes to form an intermediate layer I having a thickness of 0.5 μm.

A charge-generating layer and a charge-transporting layer were formed on the intermediate layer I in the same manner as in the electrophotographic photosensitive member 1.

Thus, an electrophotographic photosensitive member 6 was produced, which was obtained by placing, on the support, the conductive layer, the intermediate layer I, the charge-generating layer, and the charge-transporting layer in this order.

The electrophotographic photosensitive member 6 was evaluated in the same manner as in the electrophotographic photosensitive member 1 of Example 1. Table 1 shows the results.

Example 7

A conductive layer and an intermediate layer II were formed in this order on a support in the same manner as in the electrophotographic photosensitive member 1.

Next, 10 parts of Exemplified Compound (2-1) and 5 parts of a polyvinyl benzal resin were added to 250 parts of tetrahydrofuran, and the whole was dispersed for 3 hours by means of a sand mill device using glass beads each having a diameter of 1 mm. 250 parts of cyclohexanone and 250 parts of tetrahydrofuran were added to the resultant dispersion to prepare an application liquid for an intermediate layer I.

The application liquid for an intermediate layer I was applied on the intermediate layer II by means of dip coating, and the resultant coating film was dried at 80° C. for 10 minutes to form an intermediate layer I having a thickness of 0.08 μm.

Next, a hydroxygallium phthalocyanine crystal of a crystal form having strong peaks at 7.5°, 9.9°, 16.3°, 18.6°, 25.1°, and 28.3° of 2θ±0.2° (θ represents a Bragg angle in CuKα X-ray diffraction) (charge-generating substance) and 5 parts of a polyvinyl butyral resin (trade name: S-LEC® BX-1, manufactured by Sekisui Chemical Co., Ltd.) were added to 250 parts of cyclohexanone, and the whole was dispersed for 3 hours by means of a sand mill device using glass beads each having a diameter of 1 mm. 250 parts of ethyl acetate were added to the resultant dispersion to prepare an application liquid for a charge-generating layer.

The application liquid for a charge-generating layer was applied on the intermediate layer I by means of spray coating, and the resultant coating film was dried at 80° C. for 10 minutes to form a charge-generating layer having a thickness of 0.16 μm.

Next, 10 parts of the compound having the structure represented by the formula (3) (charge-transporting substance) and 10 parts of a polycarbonate resin (trade name: IUPILON® Z-200, manufactured by Mitsubishi Gas Chemical Company, Inc.) were dissolved into 70 parts of monochlorobenzene to prepare an application liquid for a charge-transporting layer. The application liquid for a charge-transporting layer was applied on the charge-generating layer by means of dip coating, and the resultant coating film was dried at 100° C. for 1 hour to form a charge-transporting layer having a thickness of 25 μm.

Thus, an electrophotographic photosensitive member 7 was produced, which was obtained by placing, on the support, the conductive layer, the intermediate layer II, the intermediate layer I, the charge-generating layer, and the charge-transporting layer in this order.

The electrophotographic photosensitive member 7 was evaluated in the same manner as in the electrophotographic photosensitive member 1 of Example 1. Table 1 shows the results.

Example 8

An electrophotographic photosensitive member 8 was produced in the same manner as in the electrophotographic photosensitive member 7 except that the thickness of the intermediate layer I was changed from 0.08 μm to 0.16 μm.

The electrophotographic photosensitive member 8 was evaluated in the same manner as in the electrophotographic photosensitive member 1 of Example 1. Table 1 shows the results.

Example 9

An aluminum cylinder the surface of which had been subjected to a honing treatment to have a surface roughness (Rz value) of 1.0 μm was prepared as a support.

An intermediate layer II, an intermediate layer I, a charge-generating layer, and a charge-transporting layer were formed on the support in the same manner as in the electrophotographic photosensitive member 8.

Thus, an electrophotographic photosensitive member 9 was produced, which was obtained by placing, on the support, the intermediate layer II, the intermediate layer I, the charge-generating layer, and the charge-transporting layer in this order.

The electrophotographic photosensitive member 9 was evaluated in the same manner as in the electrophotographic photosensitive member 1 of Example 1. Table 1 shows the results.

Example 10

An intermediate layer I, a charge-generating layer, and a charge-transporting layer were formed on a support in the same manner as in the electrophotographic photosensitive member 9 except that an intermediate layer II was not formed.

Thus, an electrophotographic photosensitive member 10 was produced, which was obtained by placing, on the support, the intermediate layer I, the charge-generating layer, and the charge-transporting layer in this order.

The electrophotographic photosensitive member 10 was evaluated in the same manner as in the electrophotographic photosensitive member 1 of Example 1. Table 1 shows the results.

Example 11

An electrophotographic photosensitive member 11 was produced in the same manner as in the electrophotographic photosensitive member 8 except that the polyvinyl benzal resin used for the intermediate layer I was changed to a phenol resin (trade name: PL-4852, manufactured by Gunei Chemical Industry Co., Ltd.).

The electrophotographic photosensitive member 11 was evaluated in the same manner as in the electrophotographic photosensitive member 1 of Example 1. Table 1 shows the results.

Example 12

An electrophotographic photosensitive member 12 was produced in the same manner as in the electrophotographic photosensitive member 8 except that Exemplified Compound (2-1) used for the intermediate layer I was changed to Exemplified Compound (2-9).

The electrophotographic photosensitive member 12 was evaluated in the same manner as in the electrophotographic photosensitive member 1 of Example 1. Table 1 shows the results.

Example 13

An electrophotographic photosensitive member 13 was produced in the same manner as in the electrophotographic photosensitive member 8 except that Exemplified Compound (2-1) used for the intermediate layer I was changed to Exemplified Compound (2-14).

The electrophotographic photosensitive member 13 was evaluated in the same manner as in the electrophotographic photosensitive member 1 of Example 1. Table 1 shows the results.

Example 14

An electrophotographic photosensitive member 14 was produced in the same manner as in the electrophotographic photosensitive member 8 except that the compound having the structure represented by the formula (3) used for the charge-transporting layer was changed to a compound having a structure represented by the following formula (4).

(4)

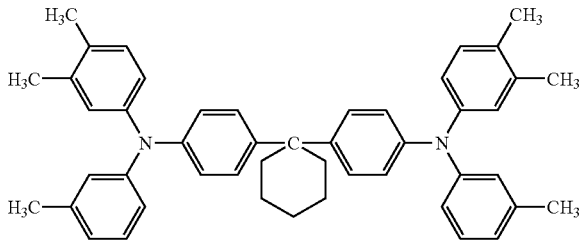

The electrophotographic photosensitive member 14 was evaluated in the same manner as in the electrophotographic photosensitive member 1 of Example 1. Table 1 shows the results.

Example 15

A conductive layer was formed on a support in the same manner as in the electrophotographic photosensitive member 1.

Next, 5 parts of Exemplified Compound (2-1) were added to 500 parts of n-butanol, and the whole was dispersed for 20 hours by means of a sand mill device using glass beads each having a diameter of 1 mm. 25 parts of a 6-66-610-12 quaternary polyamide copolymer resin and 500 parts of methanol were added to the resultant dispersion, and the whole was dispersed for an additional 2 hours by means of the same sand mill device to prepare an application liquid for an intermediate layer I.

The application liquid for an intermediate layer I was applied on the conductive layer by means of dip coating, and the resultant coating film was dried at 80° C. for 10 minutes to form an intermediate layer I having a thickness of 0.5 μm.

A charge-generating layer and a charge-transporting layer were formed on the intermediate layer I in the same manner as in the electrophotographic photosensitive member 1.

Thus, an electrophotographic photosensitive member 15 was produced, which was obtained by placing, on the support, the conductive layer, the intermediate layer I, the charge-generating layer, and the charge-transporting layer in this order.

The electrophotographic photosensitive member 15 was evaluated in the same manner as in the electrophotographic photosensitive member 1 of Example 1. Table 1 shows the results.

Example 16

An aluminum cylinder the surface of which had been subjected to a honing treatment to have a surface roughness (Rz value) of 1.0 μm was prepared as a support.

An intermediate layer I, a charge-generating layer, and a charge-transporting layer were formed on the support in the same manner as in the electrophotographic photosensitive member 15.

Thus, an electrophotographic photosensitive member 16 was produced, which was obtained by placing, on the support, the intermediate layer I, the charge-generating layer, and the charge-transporting layer in this order.

The electrophotographic photosensitive member 16 was evaluated in the same manner as in the electrophotographic photosensitive member 1 of Example 1. Table 1 shows the results.

Example 17

An electrophotographic photosensitive member 17 was produced in the same manner as in the electrophotographic photosensitive member 16 except that the thickness of the intermediate layer I was changed from 0.5 μm to 0.8 μm.

The electrophotographic photosensitive member 17 was evaluated in the same manner as in the electrophotographic photosensitive member 1 of Example 1. Table 1 shows the results.

Example 18

An electrophotographic photosensitive member 18 was produced in the same manner as in the electrophotographic photosensitive member 16 except that Exemplified Compound (2-1) used for the intermediate layer I was changed to Exemplified Compound (2-7).

The electrophotographic photosensitive member 18 was evaluated in the same manner as in the electrophotographic photosensitive member 1 of Example 1. Table 1 shows the results.

Example 19

A conductive layer was formed on a support in the same manner as in the electrophotographic photosensitive member 1.

Next, 25 parts of Exemplified Compound (2-1) were added to 500 parts of n-butanol, and the whole was dispersed for 20 hours by means of a sand mill device using glass beads each having a diameter of 1 mm. 5 parts of a 6-66-610-12 quaternary polyamide copolymer resin and 500 parts of methanol were added to the resultant dispersion, and the whole was dispersed for an additional 2 hours by means of the same sand mill device to prepare an application liquid for an intermediate layer I.

The application liquid for an intermediate layer I was applied on the conductive layer by means of dip coating, and the resultant coating film was dried at 80° C. for 10 minutes to form an intermediate layer I having a thickness of 0.5 μm.

A charge-generating layer and a charge-transporting layer were formed on the intermediate layer I in the same manner as in the electrophotographic photosensitive member 1.

Thus, an electrophotographic photosensitive member 19 was produced, which was obtained by placing, on the support, the conductive layer, the intermediate layer I, the charge-generating layer, and the charge-transporting layer in this order.

The electrophotographic photosensitive member 19 was evaluated in the same manner as in the electrophotographic photosensitive member 1 of Example 1. Table 1 shows the results.

Example 20

An electrophotographic photosensitive member 20 was produced in the same manner as in the electrophotographic photosensitive member 19 except that: the used quantity of Exemplified Compound (2-1) used for the application liquid for an intermediate layer I was changed from 25 parts to 20 parts; and the used quantity of the 6-66-610-12 quaternary polyamide copolymer resin was changed from 5 parts to 10 parts.

The electrophotographic photosensitive member 20 was evaluated in the same manner as in the electrophotographic photosensitive member 1 of Example 1. Table 1 shows the results.

Example 21

An electrophotographic photosensitive member 21 was produced in the same manner as in the electrophotographic photosensitive member 19 except that: the used quantity of Exemplified Compound (2-1) used for the application liquid for an intermediate layer I was changed from 25 parts to 3 parts; and the used quantity of the 6-66-610-12 quaternary polyamide copolymer resin was changed from 5 parts to 27 parts.

The electrophotographic photosensitive member 21 was evaluated in the same manner as in the electrophotographic photosensitive member 1 of Example 1. Table 1 shows the results.

Example 22

An electrophotographic photosensitive member 22 was produced in the same manner as in the electrophotographic photosensitive member 19 except that: the used quantity of Exemplified Compound (2-1) used for the application liquid for an intermediate layer I was changed from 25 parts to 0.3 part; and the used quantity of the 6-66-610-12 quaternary polyamide copolymer resin was changed from 5 parts to 29.7 parts.

The electrophotographic photosensitive member 22 was evaluated in the same manner as in the electrophotographic photosensitive member 1 of Example 1. Table 1 shows the results.

Example 23

An electrophotographic photosensitive member 23 was produced in the same manner as in the electrophotographic photosensitive member 19 except that: the used quantity of Exemplified Compound (2-1) used for the application liquid for an intermediate layer I was changed from 25 parts to 0.03 part; and the used quantity of the 6-66-610-12 quaternary polyamide copolymer resin was changed from 5 parts to 29.97 parts.

The electrophotographic photosensitive member 23 was evaluated in the same manner as in the electrophotographic photosensitive member 1 of Example 1. Table 1 shows the results.

Comparative Example 2

An electrophotographic photosensitive member C2 was produced in the same manner as in the electrophotographic photosensitive member 8 except that Exemplified Compound (2-1) used for the intermediate layer I was changed to a compound having a structure represented by the following formula (5).

(5)

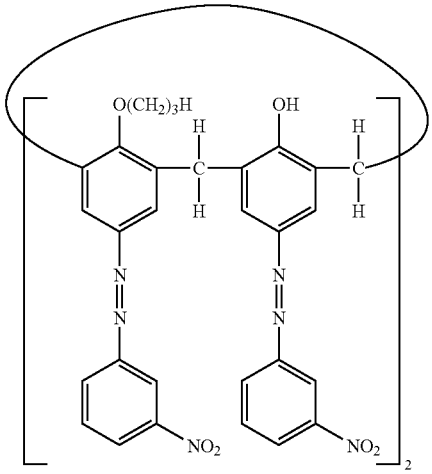

TABLE 1

| Example/ | | N/N | | N/L | | | | | H/H | | | | | Environmental change |
|---|---|---|---|---|---|---|---|---|---|---|---|---|---|---|
| | | Before durable printing | | Before durable printing | | After 500-sheet durable printing | | | Before durable printing | | After 3000-sheet durable printing | | | |
| Comparative Example | Compound used for intermediate layer I | V1 [V] | Ghost | V1 [V] | Ghost | V1 [V] | Ghost | ΔV1 [V] | V1 [V] | Ghost | V1 [V] | Ghost | ΔV1 [V] | in potential [V] |
| Example 1 | Examplified Compound(1-1) | 80 | 2 | 100 | 2 | 135 | 2 | +35 | 75 | 2 | 70 | 3 | −5 | 25 |
| Example 2 | Examplified Compound(1-1) | 90 | 1 | 110 | 1 | 140 | 2 | +30 | 80 | 2 | 85 | 3 | +5 | 30 |
| Example 3 | Examplified Compound(1-1) | 70 | 2 | 90 | 3 | 110 | 3 | +20 | 60 | 3 | 55 | 3 | −5 | 30 |
| Example 4 | Examplified Compound(1-1) | 90 | 3 | 110 | 3 | 85 | 3 | −25 | 70 | 3 | 60 | 4 | −10 | 30 |
| Example 5 | Examplified Compound(1-5) | 100 | 3 | 120 | 3 | 140 | 3 | +20 | 90 | 3 | 100 | 4 | +10 | 30 |
| Example 6 | Examplified Compound(1-1) | 105 | 2 | 120 | 2 | 155 | 3 | +15 | 90 | 3 | 80 | 4 | −10 | 30 |
| Example 7 | Examplified Compound(1-1) | 80 | 2 | 75 | 2 | 90 | 3 | +15 | 70 | 3 | 70 | 3 | 0 | 10 |
| Example 8 | Examplified Compound(2-1) | 80 | 1 | 80 | 2 | 100 | 2 | +20 | 70 | 2 | 75 | 3 | +5 | 10 |
| Example 9 | Examplified Compound(2-1) | 80 | 1 | 80 | 1 | 95 | 2 | +15 | 70 | 2 | 75 | 2 | +5 | 10 |
| Example 10 | Examplified Compound(2-1) | 80 | 2 | 80 | 2 | 90 | 2 | +10 | 65 | 3 | 60 | 3 | −5 | 15 |
| Example 11 | Examplified Compound(2-1) | 80 | 2 | 75 | 2 | 95 | 3 | +20 | 70 | 2 | 75 | 3 | +5 | 10 |
| Example 12 | Examplified Compound(2-9) | 85 | 2 | 85 | 2 | 100 | 2 | +15 | 80 | 2 | 100 | 3 | +20 | 5 |
| Example 13 | Examplified Compound(2-14 | 90 | 2 | 100 | 2 | 120 | 2 | +20 | 85 | 2 | 95 | 3 | +10 | 15 |
| Example 14 | Examplified Compound(2-1) | 80 | 1 | 80 | 2 | 100 | 2 | +20 | 70 | 2 | 80 | 3 | +10 | 10 |
| Example 15 | Examplified Compound(2-1) | 95 | 2 | 100 | 2 | 105 | 2 | +5 | 90 | 2 | 100 | 3 | +10 | 20 |
| Example 16 | Examplified Compound(2-1) | 100 | 1 | 105 | 1 | 110 | 2 | +5 | 95 | 2 | 100 | 2 | +5 | 10 |
| Example 17 | Examplified Compound(2-1) | 100 | 1 | 105 | 1 | 120 | 2 | +15 | 90 | 2 | 105 | 2 | +15 | 15 |
| Example 18 | Examplified Compound(2-7) | 105 | 1 | 110 | 1 | 115 | 2 | +5 | 95 | 2 | 100 | 2 | +15 | 15 |
| Example 19 | Examplified Compound(2-1) | 80 | 1 | 55 | 2 | 60 | 2 | +5 | 60 | 2 | 70 | 2 | +10 | 25 |
| Example 20 | Examplified Compound(2-1) | 90 | 1 | 75 | 2 | 80 | 2 | +5 | 75 | 2 | 85 | 2 | +10 | 15 |
| Example 21 | Examplified Compound(2-1) | 100 | 1 | 110 | 1 | 115 | 2 | +5 | 95 | 2 | 105 | 2 | +10 | 10 |
| Example 22 | Exemplified Compound(2-1) | 110 | 1 | 120 | 2 | 135 | 2 | +15 | 100 | 2 | 110 | 3 | +10 | 10 |
| Example 23 | Exemplified Compound(2-1) | 110 | 1 | 125 | 2 | 145 | 2 | +20 | 95 | 2 | 105 | 3 | +10 | 30 |

Comparative Example 1

An electrophotographic photosensitive member C1 was produced in the same manner as in the electrophotographic photosensitive member 1 except that the intermediate layer I was not formed.

The electrophotographic photosensitive member C1 was evaluated in the same manner as in the electrophotographic photosensitive member 1 of Example 1. Table 2 shows the results.

The electrophotographic photosensitive member C2 was evaluated in the same manner as in the electrophotographic photosensitive member 1 of Example 1. Table 2 shows the results.

Comparative Example 3

An electrophotographic photosensitive member C3 was produced in the same manner as in the electrophotographic photosensitive member 8 except that Exemplified Compound (2-1) used for the intermediate layer I was changed to a compound having a structure represented by the following formula (6).

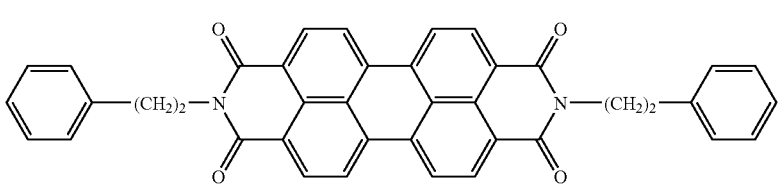

(6)

The electrophotographic photosensitive member C3 was evaluated in the same manner as in the electrophotographic photosensitive member 1 of Example 1. Table 2 shows the results.

Comparative Example 4

An electrophotographic photosensitive member C4 was produced in the same manner as in the electrophotographic photosensitive member 8 except that Exemplified Compound (2-1) used for the intermediate layer I was changed to a compound having a structure represented by the following formula (7).

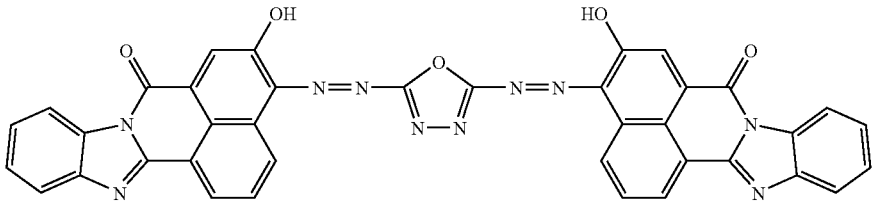

(7)

The electrophotographic photosensitive member C4 was evaluated in the same manner as in the electrophotographic photosensitive member 1 of Example 1. Table 2 shows the results.

Comparative Example 5

An electrophotographic photosensitive member C5 was produced in the same manner as in the electrophotographic photosensitive member C1 except that 10 parts of the hydroxygallium phthalocyanine crystal used for the charge-generating layer were changed to 9.5 parts of the hydroxygallium phthalocyanine crystal and 0.5 part of Exemplified Compound (1-1).

The electrophotographic photosensitive member C5 was evaluated in the same manner as in the electrophotographic photosensitive member 1 of Example 1. Table 2 shows the results.

Comparative Example 6

An electrophotographic photosensitive member C6 was produced in the same manner as in the electrophotographic photosensitive member C1 except that 10 parts of the hydroxygallium phthalocyanine crystal used for the charge-generating layer were changed to 9 parts of the hydroxygallium phthalocyanine crystal and 1 part of Exemplified Compound (2-1).

The electrophotographic photosensitive member C6 was evaluated in the same manner as in the electrophotographic photosensitive member 1 of Example 1. Table 2 shows the results.

Comparative Example 7

An electrophotographic photosensitive member C7 was produced in the same manner as in the electrophotographic photosensitive member 16 except that Exemplified Compound (2-1) used for the intermediate layer I was changed to the compound having the structure represented by the formula (7).

The electrophotographic photosensitive member C7 was evaluated in the same manner as in the electrophotographic photosensitive member 1 of Example 1. Table 2 shows the results.

TABLE 2

| Example/ Comparative Example | Compound used for intermediate layer I | N/N Before durable printing V1 [V] | N/N Before durable printing Ghost | N/L Before durable printing V1 [V] | N/L Before durable printing Ghost | N/L After 500-sheet durable printing V1 [V] | N/L After 500-sheet durable printing Ghost | N/L ΔV1 [V] | H/H Before durable printing V1 [V] | H/H Before durable printing Ghost | H/H After 3000-sheet durable printing V1 [V] | H/H After 3000-sheet durable printing Ghost | H/H ΔV1 [V] | Environmental change in potential [V] |
|---|---|---|---|---|---|---|---|---|---|---|---|---|---|---|
| Comparative Example 1 | No intermediate layer I | 110 | 3 | 130 | 4 | 190 | 4 | +60 | 90 | 4 | 100 | 5 | +10 | 40 |
| Comparative Example 2 | Formula(5) | 110 | 2 | 120 | 2 | 180 | 3 | +60 | 90 | 3 | 95 | 4 | +5 | 30 |
| Comparative Example 3 | Formula(6) | 90 | 3 | 105 | 4 | 180 | 4 | +75 | 60 | 4 | 90 | 5 | +30 | 45 |
| Comparative Example 4 | Formula(7) | 110 | 3 | 130 | 4 | 185 | 4 | +55 | 80 | 4 | 115 | 5 | +35 | 50 |
| Comparative Example 5 | No intermediate layer I | 550 | | | | Unable to evaluate owing to insufficient sensitivity | | | | | | | | |
| Comparative Example 6 | No intermediate layer I | 150 | 3 | 165 | 4 | 215 | 4 | +50 | 130 | 3 | 130 | 4 | 0 | 35 |
| Comparative Example 7 | Formula(7) | 100 | 3 | 130 | 4 | 150 | 4 | +20 | 90 | 3 | 65 | 4 | −25 | 40 |

Example 24

The photoelectric property of an electrophotographic photosensitive member produced in the same manner as in the electrophotographic photosensitive member 1 was measured by means of concave conductive glass having a diameter of 30 mm. A halogen lamp was used as a light source, and light obtained by making the light of the light source monochrome with an interference filter of a wavelength of 403 nm was used for the measurement of the photoelectric property. The initial surface potential of the electrophotographic photosensitive member was adjusted to be −700 V. At this time, an exposure value EΔ500 necessary for the surface potential to attenuate from −700 V to −200 V was measured. The lower the exposure value EΔ500, the more excellent the photoelectric property. Table 3 shows the results.

Example 25

The photoelectric property of an electrophotographic photosensitive member produced in the same manner as in the electrophotographic photosensitive member 2 was measured in the same manner as in Example 24. Table 3 shows the results.

Example 26

The photoelectric property of an electrophotographic photosensitive member produced in the same manner as in the electrophotographic photosensitive member 7 was measured in the same manner as in Example 24. Table 3 shows the results.

Example 27

The photoelectric property of an electrophotographic photosensitive member produced in the same manner as in the electrophotographic photosensitive member 8 was measured in the same manner as in Example 24. Table 3 shows the results.

Example 28

The photoelectric property of an electrophotographic photosensitive member produced in the same manner as in the electrophotographic photosensitive member 9 was measured in the same manner as in Example 24. Table 3 shows the results.

Example 29

The photoelectric property of an electrophotographic photosensitive member produced in the same manner as in the electrophotographic photosensitive member 14 was measured in the same manner as in Example 24. Table 3 shows the results.

Example 30

The photoelectric property of an electrophotographic photosensitive member produced in the same manner as in the electrophotographic photosensitive member 16 was measured in the same manner as in Example 24. Table 3 shows the results.

Example 31

The photoelectric property of an electrophotographic photosensitive member produced in the same manner as in the electrophotographic photosensitive member 21 was measured in the same manner as in Example 24. Table 3 shows the results.

Comparative Example 8

The photoelectric property of an electrophotographic photosensitive member produced in the same manner as in the electrophotographic photosensitive member C1 was measured in the same manner as in Example 24. Table 3 shows the results.

Comparative Example 9

The photoelectric property of an electrophotographic photosensitive member produced in the same manner as in the electrophotographic photosensitive member C2 was measured in the same manner as in Example 24. Table 3 shows the results.

Comparative Example 10

The photoelectric property of an electrophotographic photosensitive member produced in the same manner as in the electrophotographic photosensitive member C6 was measured in the same manner as in Example 24. Table 3 shows the results.

Comparative Example 11

The photoelectric property of an electrophotographic photosensitive member produced in the same manner as in the electrophotographic photosensitive member C7 was measured in the same manner as in Example 24. Table 3 shows the results.

TABLE 3

| Example/ Comparative Example | Electrophotographic photosensitive member used | EΔ500 [$\times 10^{-2}$ J/m$^2$] |
|---|---|---|
| Example 24 | Example 1 | 0.59 |
| Example 25 | Example 2 | 0.60 |
| Example 26 | Example 7 | 0.59 |
| Example 27 | Example 8 | 0.49 |
| Example 28 | Example 9 | 0.38 |
| Example 29 | Example 14 | 0.44 |
| Example 30 | Example 16 | 0.72 |
| Example 31 | Example 21 | 0.61 |
| Comparative Example 8 | Comparative Example 1 | 0.64 |
| Comparative Example 9 | Comparative Example 2 | 0.71 |
| Comparative Example 10 | Comparative Example 6 | 0.65 |
| Comparative Example 11 | Comparative Example 7 | 0.83 |

The electrophotographic photosensitive member of the present invention has the layer comprising at least one of the compound having the structure represented by the formula (1) and the compound having the structure represented by the formula (2) formed between the support and the charge-generating layer. As a result, a change in potential at the surface of the electrophotographic photosensitive member upon continuous printing can be suppressed to an extremely low level even in a high-temperature-and-high-humidity environment. Therefore, the electrophotographic photosensitive member of the present invention can prevent an image failure such as a ghost from occurring.

The electrophotographic photosensitive member of the present invention can also suppress an abrupt change in potential at the surface of the electrophotographic photosensitive member at an initial stage of image formation or a change in potential at the surface of the electrophotographic photosensitive member during long-term durable use to an extremely low level even in a low-humidity environment. Therefore, the electrophotographic photosensitive member of the present invention can prevent a change in image density or an image failure such as a ghost from occurring.

That is, the electrophotographic photosensitive member of the present invention having the layer containing at least one of the compound having the structure represented by the formula (1) and the compound having the structure represented by the formula (2) can be said to be an electrophotographic photosensitive member excellent in environmental stability, the electrophotographic photosensitive member being capable of forming a good image for a long period of time in any environment.

The electrophotographic photosensitive member of the present invention is available for electrophotographic copying machines. In addition, the electrophotographic photosensitive member is widely applicable to the fields where electrophotography is applied such as a laser beam printer, a CRT printer, an LED printer, a FAX, a liquid crystal printer, and laser plate making.

This application claims priority from Japanese Patent Application No. 2004-157521 filed on May 27, 2004, which is hereby incorporated by reference herein.

What is claimed is:

1. An electrophotographic photosensitive member, comprising:

an electrically conductive support;

a charge-generating layer which is placed on the support, comprising a charge-generating substance; and a charge-transporting layer which is placed on the charge-generating layer, comprising a charge-transporting substance, wherein the electrophotographic photosensitive member comprises a layer, comprising a polyamide resin and a compound having a structure represented by the following formula, between the support and the charge-generating layer:

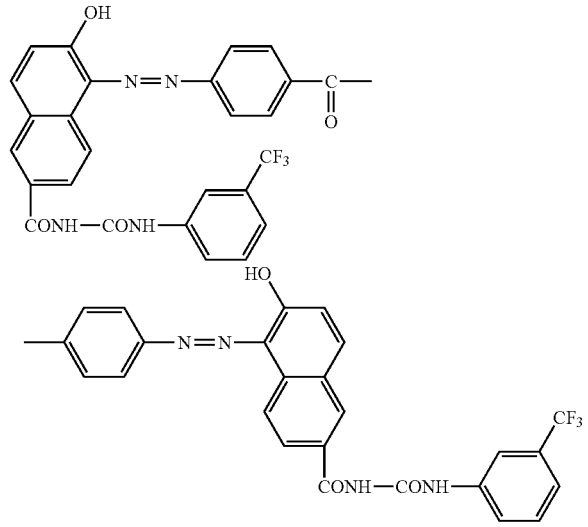

wherein the polyamide resin is 6-66-610-12 quaternary polyamide copolymer resin.

2. The electrophotographic photosensitive member according to claim 1, wherein the charge-generating substance is a phthalocyanine pigment.

3. The electrophotographic photosensitive member according to claim 2, wherein the phthalocyanine pigment is gallium phthalocyanine.

4. The electrophotographic photosensitive member according to claim 3, wherein the gallium phthalocyanine is hydroxygallium phthalocyanine.

5. The electrophotographic photosensitive member according to claim 4, wherein the hydroxygallium phthalocyanine is a hydroxygallium phthalocyanine crystal of a crystal form having strong peaks at 7.4° ±0.3° and 28.2° ±0.3° of 2θ±0.20°, wherein θ represents a Bragg angle in CuKα X-ray diffraction.

6. The electrophotographic photosensitive member according to claim 1 or 2, wherein a ratio (A/B) of a total mass (A) of the compound having the structure represented by the formula to a total mass (B) of the layer comprising the compound having the structure represented by the formula is 0.05 to 0.70.

7. The electrophotographic photosensitive member according to claim 1 or 2, wherein the layer comprising the compound having the structure represented by the formula has a thickness of 0.03 to 1.0 μm.

8. A process cartridge detachably attached to a main body of an electrophotographic apparatus, wherein the process cartridge supports as one unit:

the electrophotographic photosensitive member according to claim 1 or 2; and at least one device selected from the group consisting of a charging device, a developing device, a transferring device, and a cleaning device.

9. An electrophotographic apparatus, comprising: the electrophotographic photosensitive member according to claim 1 or 2; a charging device; an exposing device; a developing device; and a transferring device.

10. The electrophotographic apparatus according to claim 9, wherein the exposing device has a laser having an oscillation wavelength in a range of 380 to 450 nm.

* * * * *

UNITED STATES PATENT AND TRADEMARK OFFICE

CERTIFICATE OF CORRECTION

PATENT NO. : 7,452,644 B2
APPLICATION NO. : 11/358204
DATED : November 18, 2008
INVENTOR(S) : Masato Tanaka et al.

It is certified that error appears in the above-identified patent and that said Letters Patent is hereby corrected as shown below:

ON THE TITLE PAGE
At Item (75), Inventors, "Mishimi" should read --Mishima--.

COLUMN 2
Line 22, "intermediate is" should read --intermediate layer is--.
Line 37, "ghost;" should read --ghost--.

COLUMN 15
Line 56, "layer");" should read --layer")--.

COLUMN 16
Line 7, "layer II");" should read --layer II")--.

COLUMN 22
Line 60, "The" should begin a new paragraph.

COLUMNS 27 AND 28 IN TABLE 1
Line 36, "Examplified" should read --Exemplified--.
Line 37, "Examplified" should read --Exemplified--.
Line 38, "Examplified" should read --Exemplified--.
Line 39, "Examplified" should read --Exemplified--.
Line 40, "Examplified" should read --Exemplified--.
Line 41, "Examplified" should read --Exemplified--.
Line 42, "Examplified" should read --Exemplified--.
Line 43, "Examplified" should read --Exemplified--.
Line 44, "Examplified" should read --Exemplified--.
Line 45, "Examplified" should read --Exemplified--.
Line 46, "Examplified" should read --Exemplified--.
Line 47, "Examplified" should read --Exemplified--.
Line 48, "Examplified" should read --Exemplified--.
Line 49, "Examplified" should read --Exemplified--.

Signed and Sealed this

Twenty-second Day of June, 2010

David J. Kappos

David J. Kappos
*Director of the United States Patent and Trademark Office*

COLUMNS 27 AND 28 IN TABLE 1 (CONTINUED)
Line 50, “Examplified” should read --Exemplified--.
Line 51, “Examplified” should read --Exemplified--.
Line 52, “Examplified” should read --Exemplified--.
Line 53, “Examplified” should read --Exemplified--.
Line 54, “Examplified” should read --Exemplified--.
Line 55, “Examplified” should read --Exemplified--.
Line 56, “Examplified” should read --Exemplified--.
Line 57, “Examplified” should read --Exemplified--.
Line 58, “Examplified” should read --Exemplified--.